United States Patent [19]

Smrekar

[11] 4,371,371

[45] Feb. 1, 1983

[54] PROCESS FOR DYEING TEXTILE MATERIALS IN SOLID SHADES

[75] Inventor: Joseph J. Smrekar, LaGrange, Ga.

[73] Assignee: Milliken Research Corporation, Spartanburg, S.C.

[21] Appl. No.: 273,369

[22] Filed: Jun. 15, 1981

[51] Int. Cl.[3] ..... D06P 3/82; D06B 1/02

[52] U.S. Cl. ..... 8/531; 8/680; 8/685; 8/151; 8/158; 8/917; 8/924; 8/929; 68/205 R

[58] Field of Search ..... 8/531, 680, 685, 151, 8/158; 68/205 R

[56] References Cited

U.S. PATENT DOCUMENTS

| | | | |
|---|---|---|---|
| 3,969,779 | 7/1976 | Stewart | 8/147 |
| 4,019,352 | 4/1977 | McColloush et al. | 68/205 R |
| 4,033,154 | 7/1977 | Johnson | 68/205 R |
| 4,084,615 | 4/1978 | Klein et al. | 118/314 |
| 4,095,444 | 6/1978 | Pascoe et al. | 68/205 R |
| 4,116,626 | 9/1978 | Varner | 8/149 |

*Primary Examiner*—A. Lionel Clingman
*Attorney, Agent, or Firm*—H. William Petry; Terry T. Moyer

[57] ABSTRACT

A process is provided for dyeing textile materials in a solid shade with a jet injection dyeing apparatus, including conveying means for transporting the textile, jet orifices for delivering dye to said textile material, and control means for supplying data to control the operation of the application of dye from the jet orifices to the textile material, which comprises the steps of: modifying the textile material prior to dyeing of same by applying to said textile material an aqueous admixture containing an effective minor amount of a thickening agent to maintain the viscosity of said aqueous admixture at from about 150 to about 750 centipoises, preferably about 200 to about 400 centipoises, to thoroughly wet said textile material; dyeing said textile material in a solid shade with an acid dye composition having a viscosity of from about 150 to about 750 centipoises, preferably from about 200 to about 400 centipoises, by applying said dye composition by means of said jet injection dyeing apparatus in an amount of at least about 300 percent based on the weight of said textile material; the pH of the textile material at the point of contact between said dye composition and said textile material being maintained at from about 3.5 to about 7.5, fixing said dye on said textile material, washing said textile material to remove any unfixed dye, and recovering a resulting textile material dyed in a solid shade.

9 Claims, 1 Drawing Figure

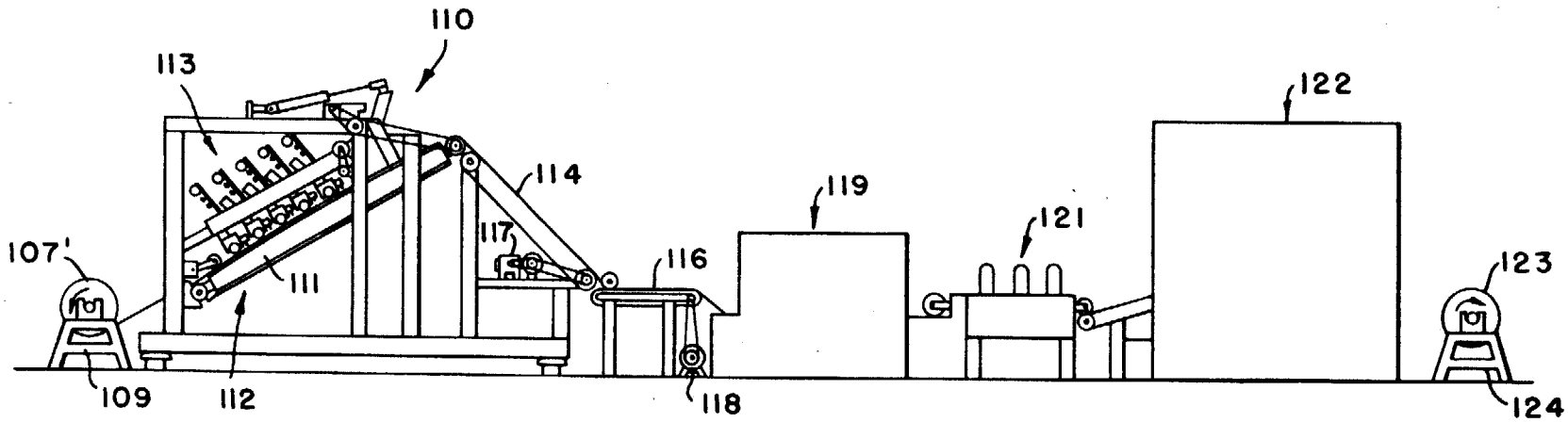
107'
109
110
111
112
113
114
116
117
118
119
121
122
123
124

PROCESS FOR DYEING TEXTILE MATERIALS IN SOLID SHADES

This invention relates to an improved process for dyeing textile materials in solid shades. In one aspect the invention relates to the solid shade dyeing of textile materials by means of a jet dye injection machine.

Textile materials have heretofore been colored using natural and synthetic dyes by numerous processes, such as transfer printing, jet injection dyeing, and the like. Further, such processes have been employed to print a color decoration on the surface or surfaces of the material in definite repeated forms and colors to produce a pattern. While such prior dyeing processes have met with success, it would be desirable to adapt such processes which have been ordinarily used to print patterns on the textile material to provide textile materials dyed in solid shades. While such solid shade dyeing has heretofore been successfully accomplished traditionally by means of, for instance, the so-called Beck dyeing technique or the so-called Kuster dyeing technique, among others, it would be highly advantageous to provide a process for dyeing textile materials in solid shades by means of, for instance, jet dye injection apparatus since the shade or color could be changed almost instantaneously to provide any desired length of textile material in any desired color. Such processing flexibility would assist in inventory control and in meeting customers' orders in a very expeditious fashion.

Accordingly, the present invention provides an improved process for dyeing textile materials in solid shades by means of a jet dye injection apparatus. The present invention also provides a method for dyeing textile materials such as carpeting, and especially tufted carpeting, uniformly and evenly by means of a dye injection apparatus. The present invention further provides a solution to the problem of dyeing textiles in solid shade by means of a dye injection machine by achieving even distribution of a relatively small amount of dye throughout the material to be dyed and fixing it there by heating, steaming, or chemical means.

Accordingly, a process is provided for dyeing textile materials in a solid shade with a jet injection dyeing apparatus, including conveying means for transporting the textile material, jet orifices for delivering dye to said textile material, and control means for supplying data to control the operation of the application of dye from the jet orifices to the textile material, which comprises the steps of: modifying the textile material prior to dyeing of same by applying to said textile material an aqueous admixture containing an effective minor amount of a thickening agent to maintain the viscosity of said aqueous admixture at from about 150 to about 750 centipoises, preferably about 200 to about 400 centipoises, to thoroughly wet said textile material; dyeing said textile material in a solid shade with an acid dye composition having a viscosity of from about 150 to about 750 centipoises, preferably from about 200 to about 400 centipoises, by applying said dye composition by means of said jet injection dyeing apparatus in an amount of at least about 300 percent based on the weight of said textile material; the pH of the textile material at the point of contact between said dye-composition and said textile material being maintained at from about 3.5 to about 7.5, fixing said dye on said textile material, washing said textile material to remove any unfixed dye, and recovering a resulting textile material dyed in a solid shade.

When reference is made herein to viscosity measurements, viscosity was determined in each instance using a Brookfield viscometer, spindle number 3 at twenty revolutions per minute. As mentioned, the viscosity of the aqueous admixture and of the dye composition both may be at least about 150 centipoises. If the viscosity drops much below this value, the fluid may drip or even flow out of the gun bars from which it is applied in controlled fashion to the textile material. If a viscosity above about 750 is employed recirculation of the fluid, e.g., aqueous admixture or dye composition, may become difficult or even impossible.

The amount of dye composition applied to the textile material may be at least about 300 percent, preferably at least about 350 percent, based on the weight of the textile material. If less than about 300 percent is applied, penetration of the dye into the substrate may not be sufficient. In practice as much as about 500 percent by weight dye composition may be employed. While even larger amounts may be used without adversely affecting the characteristics of the product material, no substantial improvements in coloration are observed and economic considerations may not justify such amounts.

The dyes of the present invention are "acid dyes." As used herein the term "acid dye" is intended to refer to dyes which are generally known in the art to be applied from a bath containing acid, although some may be applied from a neutral bath. Acid dyes contain as the active principle component aromatic compounds, including in their chemical structure both a chromophoric group and a water-solubilizing group such as a sulfonic acid radical. Typical commercial acid dyes may be provided in the form of the alkali metal salt normally standardized, that is, diluted to a standard effective concentration with a cutting agent such as, for instance, sodium sulfate.

The acid dyes of the present invention may be divided into three types: simple acid dyes, mordant acid dyes, and premetalized acid dyes. Simple acid dyes are those that do not contain polyvalent metals in their composition. The chemical classes of simple acid dyes include nitro, monazo, diazo, nitroso, monsazo (metalized), triphenylmethane, xanthene, anthraquinone, azine, and quinoline. Acid dyes of the present invention that can combine simultaneously with a mordanting substance, most generally a complex and hydrated chromic hydroxide, and with the fiber are called mordant acid dyes. Some examples of mordant acid dyes include anthraquinone, monoazo, diazo, oxazine, xanthene, triphenylmethane, nitroso, and naphthoquinone. The premetalized acid dyes within the scope of the present invention fall into two major categories, referred to as 1:1 and 1:2 metal complex dyes. The 1:1 metal complex dyes contain one metallic atom for each dye molecule. The 1:2 metal complex dyes contain one metallic atom for two dye molecules. The dye molecules in the latter can be either the same or different. Usually the dye molecule is an azo type or an azomethine. The metal in most instances is chromium, but sometimes cobalt and iron may be used. Because of their level dyeing characteristics, the premetalized acid dyes may be particularly suitable, and hence preferred, for dyeing in solid shades. Another advantage of the premetalized dyes, besides their fastness and ease of application, is that they may minimize the selective affinity of different grades and qualities of fibers in the fabric substrate.

The dye compositions of the present invention may include various assistants. In general, these assistants may fulfill at least two significant functions: they promote (a) level dyeing and (b) exhaustion. The two assistants which may be used for these purposes include anhydrous sodium sulfate, or even Glauber's salt ($Na_2SO_4.10H_2O$) and a suitable acid. The action of the acid and of the sodium sulfate or Glauber's salt can be readily understood based upon the observation that a dyed piece of a fabric substrate such as, for instance, wool may lose color to a greater extent and more rapidly in a boiling solution of sodium sulfate than in boiling water, and more rapidly in boiling water than in a solution of boiling acid. Thus the sodium sulfate promotes levelness by holding dye off the fabric substrate while the acid drives dye onto the fabric substrate. Acids commonly employed in promoting exhaustion include, for instance, sulfuric, formic, acetic, phosphoric, sulfamic, glycolic, and lactic acids, depending upon the dyeing properties of the dye and the fabric substrate to be dyed.

In general, it has heretofore been believed that sufficient acid should be provided in the dye compositions employed in apparatus of the type described herein to provide a pH of from about 2.5 to about 3.0. While such pH conditions have been found to be quite satisfactory when dyeing textile materials in a pattern, when solid shade dyeing is to be performed using such apparatus non-uniformity and other defects have been observed in the dyed products. It has thus been found, that when it is desired to dye using acid dyes as described herein in solid shades using the apparatus of the type described herein, the pH of the liquid phase on the textile material to be dyed immediately after application of the dye to the textile material should be from about 3.5 to about 7.5, preferably about 5 to about 7.5, e.g., about 6.0 to about 6.5.

This result, that is the maintenance of the pH on the textile material to which the acid dye composition has been applied in the desired range, may be accomplished by at least two alternative preferred means although the invention is not to be limited to such preferred means. First, the pH of the aqueous admixture applied to the textile material prior to dyeing to modify the material may be adjusted to maintain the desired pH of the liquid phase on the material after dye application at the desired level. Thus rather than applying an aqueous admixture having a relatively neutral pH, the pH may be adjusted to from about 8 to about 12, preferably from about 9 to 11. Alternatively, the pH of the dye composition itself may be controlled by adjusting the amount of acid added to the dye composition itself to provide a dye composition having a pH of from about 3.5 to about 7.5, preferably about 5.5 to about 7, say about 6 to about 6.5. Of course these two embodiments of the invention are not mutually exclusive and in fact the desired pH on the surface of the textile material may be accomplished by adjusting both the pH of the dye composition and the aqueous admixture to accomplish the desired result.

Other assistants that may be used in the dye compositions of the present invention include penetrating agents, e.g., wetting agents, level dyeing assistants besides sodium sulfate, water-softening agents, lime-soap dispersing agents, and chemicals that minimize the color-modifying effect of metals such as nickel, copper, or iron used in the construction of dyebaths. A good wetting agent for an acid dyebath should at the same time have good dispersive power so as to disperse any lime soap or lime salt of the dye, if any is formed, and thus to keep the bath clean and free from scum. The sulfonated wetting agents can, at the same time, have an initial retarding effect on the exhaustion of an acid dye, because they also exhaust on the fabric substrate and are then displaced gradually so as to give a leveling as well as a wetting action in dyeing. The destructive action of metals of construction such as iron, copper, nickel, or Monel on the color of dyeings can be minimized by the presence of chemicals that form slightly ionized complexes. For this, the sodium salt of ethylenediaminetetraacetic acid may be most effective, but sodium thiocyanate may also be employed.

In dyeing nylon with the 1:2 metal complex acid dyes of the neutral dyeing type, unevenness caused by their strong affinity for nylon may be avoided by carefully controlling temperatures and pH. These dyes also may tend to accentuate barre in fabric substrates made from filament yarns due to variations in the yarns, but are well suited for dyeing fabrics made from spun yarns because of their excellent fastness properties.

The acid dye compositions described herein may be used in the process of the invention to dye a wide variety of fabric substrates. The process of the invention may be particularly suitable for dyeing wool textiles, nylon textiles, and nylon-wool blends in solid shades. Such textile materials may be characterized as tufted textile materials and are generally known as carpeting and upholstery fabrics. When the textile material is a tufted textile material such as carpeting, the pile fibers may preferably be spun fibers rather than filamentary fibers. It has been found that dyeing of carpeting tufted from filamentary yarns may result in the magnification of any yarn or texturing irregularity in the form of an obvious band or streak. Dyeing of fabrics tufted from spun fabrics by contrast may provide a more uniformly dyed solid shade product.

The textile materials which may be dyed in solid shades using the dye compositions of the present invention are dyed using a jet dyeing process and apparatus such as disclosed in U.S. Pat. Nos. 4,084,615; 4,034,584; 3,985,006; 4,059,880; 3,937,045; 3,894,413; 3,942,342; 3,939,675; 3,892,109; 3,942,343; 4,033,154; 3,969,779; 4,019,352; pending U.S. Patent Application U.S. Ser. No. 686,900, filed May 17, 1976, entitled "Printing of Pattern Designs with Computer Controlled Pattern Dyeing Device"; and U.S. Patent Application U.S. Ser. No. 806,783, filed June 15, 1977, entitled "Apparatus for the Application of Liquids to Moving Materials," each of said patents and patent applications being hereby expressly incorporated by reference.

In a jet dyeing process and apparatus such as set forth in U.S. Pat. No. 3,969,779, a jet pattern dyeing machine is provided with a plurality of gun bars each containing plural dye jets extending across the width of an endless conveyor. The gun bars are spaced along the conveyor, and the textile material is carried by the conveyor past the gun bars where dyes are ordinarily applied to form a pattern thereon, although, according to the present invention, all of the jets on a gun bar will contain the same color dye composition and the apparatus will be programmed to provide a solid shade, dyed product. The application of the dye from the individual dye jets in the gun bars is controlled by suitable adapted pattern control means such as mentioned in U.S. Pat. Nos. 3,969,779 and 4,033,154.

Application of the dye is thus by conventional means as described in the references with regard to pattern dyeing, although the firing time of the dye jets may be increased somewhat to provide the increased wet pickup of the dye composition of more than about 300 percent, preferably more than about 350 percent desired for solid shade dyeing. By contrast, a somewhat lower wet pickup may be common for dyeing in a pattern using the apparatus described herein. Thus the firing time for the dye jets may be increased to about 25 milliseconds or less for print dyeing, to about 30 milliseconds or more, e.g., about 32 milliseconds.

Firing time, it should be understood, may be dependent upon greige weight of the substrate to be dyed. After dyeing, the textile material dyed in a solid shade may then be passed through a steamer wherein the dyed textile material is subjected to a steam atmosphere to fix the dyes thereon. The textile material dyed in a solid shade leaving the steam chamber is conveyed through a water washer to remove excess unfixed dye therefrom. The washed textile material is then passed through a hot air dryer to a delivery and takeup means.

In order to more fully depict the process for dyeing textile materials in solid shades in accordance with the invention, reference will now be made to the drawing where a jet dyeing apparatus is depicted to dye the textile material. Supply roll 107' is mounted on a suitable support 109. The textile material is advanced through dyeing apparatus 110 as follows. The textile material is advanced onto the lower end of inclined conveyor 111 of jet applicator section 112, where an aqueous solution is applied to pre-wet the textile material to be dyed in a solid shade. The aqueous solution is applied by a programmed operation of a plurality of jet gun bars, generally indicated at 113, which inject streams of aqueous solution onto the face surface of the textile material during its passage thereunder. As the textile material moves from the lower end of inclined conveyor 111 toward the upper end thereof it passes another series of jet gun bars (also indicated at 113) which inject streams of dye onto the face surface of the textile material to dye it in a solid shade. The solid-shade-dyed textile material leaving the applicator section is moved by conveyors 114 and 116, driven by motors 117 and 118 to a steam chamber 119, where the textile material is subjected to a steam atmosphere to fix the dye thereon. The dyed textile material leaving steam chamber 119 is conveyed through a water washer 121 to remove excess unfixed dye from the textile material. Thereafter, the washed textile material is passed through a hot air dryer 122 to takeup roll 123, which is mounted on a suitable support 124.

The above sequence of steps and processes set forth schematically illustrates the most desired method for producing the improved products in accordance with the subject invention. In order to more fully illustrate the concept of the subject invention, the following examples are given. However, it is to be understood that such examples are not to be construed as unduly limiting the scope of the invention as set forth in the appended claims.

EXAMPLE 1

In this Example, the dye mix consisted of a low-solids, high-viscosity guar gum (V60 from Celanese Chemical Co.) to a viscosity of 150 cps, mono sodium phosphate, to a final mixture pH of 6.0, non-silicone antifoam (Antifoam 35-3), and premetalized acid dyes. The remainder of the composition was water. The aqueous admixture (wetout) consisted of guar gum to a viscosity of 150 cps, 0.0417 pounds per gallon of Synofoam K1 from Milliken Chemical. The remainder of the composition was water. The process was performed on a nylon material (Monsanto T-1800 Staple type 66 fiber) which was in the form of a tufted carpet with a 3/16 inch tufting gauge, pile height of 43/64 inch, 5.06 stitches per inch, and 24.5 ounces per square yard pile weight.

The product was wetted with the aqueous admixture to approximately 80% wet pickup based on pile weight. The dye mix was applied in full coverage from one gunbar to a wet pickup of approximately 300%. The application of the dye mix was by means of the apparatus described in U.S. Pat. No. 4,084,615. The fabric was then steamed at 212° F. for 10 minutes to fix the dye. It was then washed with water at 70° F. to remove any chemicals and thickeners present on the fabric. The fabric was then dried.

After the process the following observations were made:

1. There were no streaks due to the application of a dye through discrete jets.
2. The color uniformity of the color across the width was within accepted tolerances for solid coloration products.
3. The overall color uniformity was good, with an absence of spots, splotches, wavy lines, and skitteriness that destroys the solid coloration look.
4. The product produced was comparable to the solid coloration produced using a Kuster applicator which floods the fabric with a sheet of dye mix.

EXAMPLE 2

The procedure of Example 1 was repeated using a dye mix in which the pH was adjusted to 3.0 pH using sulfamic acid and the viscosity was adjusted to 300 cps. The final product had streaks caused by the application of dye through the jets. The product was unacceptable for solid colorations.

EXAMPLE 3

The procedure of Example 1 was repeated using a dye mix in which only the viscosity was changed to 800 cps. The final product had streaks due to the application of the dye through the jets. The dyeing was unacceptable.

EXAMPLE 4

The procedure of Example 1 was repeated using a dye mix in which only the pH was changed to 3.0. The color uniformity of the final product was poor, having an overall "skittery" appearance and was unacceptable.

EXAMPLE 5

The procedure of Example 1 was repeated, using the dye mix of Example 2 with the pH of the aqueous admixture adjusted to approximately 10.0 with ammonia. The final product had good overall appearance and was comparable to the product produced in Example 1.

What is claimed is:

1. A process for dyeing textile materials in a solid shade with a jet injection dyeing apparatus, including conveying means for transporting the textile, jet orifices for delivering dye to said textile material, and control means for supplying data to control the operation of the application of dye from the jet orifices to the textile material, which comprises the steps of: modifying the textile material prior to dyeing of same by applying to said textile material an aqueous admixture containing an effective minor amount of a thickening agent to maintain the viscosity of said aqueous admixture at from about 150 to about 750 centipoises to thoroughly wet said textile material; dyeing said textile material in a solid shade with an acid dye composition having a viscosity of from about 150 to about 750 centipoises by applying said dye composition by means of said jet dyeing apparatus in an amount of at least about 300 percent based on the weight of said textile material; the pH of the textile material at the point of contact between said dye-composition and said textile material being maintained at from about 3.5 to about 7.5, fixing said dye on said textile material, washing said textile material to remove any unfixed dye, and recovering a resulting textile material dyed in a solid shade.

2. The product produced by the process of claim 1.

3. The process as defined in claim 1 wherein said pH is maintained on said textile material in the range of from about 3.5 to about 7.5 by adjusting the pH of the aqueous admixture employed to modify the textile material prior to dyeing of same to a range of from about 8 to about 12.

4. The process of claim 1 wherein said pH is maintained on said textile material in the range of from about 3.5 to about 7.5 by adjusting the pH of the dye composition to from about 3.5 to about 7.5.

5. The process as defined in claim 1, wherein said acid dye is selected from a simple acid dye, and a premetalized acid dye.

6. The process of claim 5, wherein said acid dye is a simple acid dye selected from nitro, monazo, diazo, nitroso, triphenylmethane, xanthene, anthraquinone, azine, and quinoline dyes.

7. The process of claim 5, wherein said acid dye is a premetalized acid dye.

8. The process of claim 1, wherein said textile material is a tufted material wherein said tufts are comprised of spun yarns, the composition of said yarns being selected from nylon, wool, and nylon-wool blends.

9. The process of claim 8, wherein said textile material is a carpet.

* * * * *